US005483806A

United States Patent [19]

Miller et al.

[11] Patent Number: 5,483,806

[45] Date of Patent: Jan. 16, 1996

[54] REFRIGERATION SYSTEM

[76] Inventors: Jeremy P. Miller, Copse View, Summerlug, Mortimer, Nr. Reading, Berkshire RG7 2JS; Colin D. Smith, 13 Highbury Crescent, Camberley, Surrey; Rodney J. Allam, "Westacre", Guildown Road, St Catherines, Guildford, Surrey; Anthony K. J. Topham, 30 Mayo Road, Walton-on-Thames, Surry KT12 2QA, all of Great Britain

[21] Appl. No.: 439,802

[22] Filed: May 12, 1995

[30] Foreign Application Priority Data

May 16, 1994 [GB] United Kingdom ..... 94 09754

[51] Int. Cl.[6] ..... F25D 9/00

[52] U.S. Cl. ..... 62/402; 62/40

[58] Field of Search ..... 62/40, 402, 401

[56] References Cited

U.S. PATENT DOCUMENTS

| | | | |
|---|---|---|---|
| 3,038,318 | 6/1962 | Hänny | 62/402 X |
| 3,144,316 | 8/1964 | Koehn et al. | 62/40 X |
| 3,194,025 | 7/1965 | Grossmann | 62/40 X |
| 3,194,026 | 7/1965 | La Fleur | 62/402 X |
| 3,200,613 | 8/1965 | Zotos | 62/402 |
| 3,300,991 | 1/1967 | Carney | 62/40 X |
| 3,340,698 | 9/1967 | Ichihara | 62/40 X |
| 3,355,903 | 12/1967 | La Fleur | 62/402 X |
| 3,358,460 | 12/1967 | Smith et al. | 62/40 X |
| 3,362,173 | 1/1968 | Kniel | 62/40 X |
| 3,394,555 | 7/1968 | La Fleur | 62/40 X |
| 3,693,637 | 10/1972 | Ness et al. | 62/402 |
| 3,868,827 | 3/1975 | Linhardt et al. | 62/401 X |
| 3,874,185 | 4/1975 | Etzbach | 62/40 |
| 4,169,361 | 10/1979 | Baldus | 62/402 |
| 4,291,547 | 9/1981 | Leo | 62/402 |
| 4,315,409 | 2/1982 | Prentice et al. | 62/401 X |
| 4,334,902 | 6/1982 | Paradowski | 62/402 X |
| 4,539,816 | 9/1985 | Fox | 62/87 |
| 4,665,973 | 5/1987 | Limberg et al. | 62/402 X |
| 4,740,223 | 4/1988 | Gates | 62/40 X |
| 5,214,935 | 6/1993 | Brunskill | 62/402 |

FOREIGN PATENT DOCUMENTS

| | | |
|---|---|---|
| 0231116 | 8/1987 | European Pat. Off. . |
| 871877 | 7/1961 | United Kingdom . |
| 1038741 | 8/1966 | United Kingdom . |
| 1098059 | 1/1968 | United Kingdom . |
| 2026152 | 1/1980 | United Kingdom . |
| 2087540 | 5/1982 | United Kingdom . |
| 2237373 | 5/1991 | United Kingdom . |

OTHER PUBLICATIONS

Fundamentals and History of Air Cycle Refrigeration, Proc.–Food Refrigeration and Process Engineering Research Center, 9 Nov. 1993, Langford, United Kingdom.

Environmentally Benign Air Cycle Heat Pumps and Refrigeration Systems, Proc.–Food Refrigeration and Process Engineering Research Centre, 9 Nov. 1993, Langford, United Kingdom.

*Primary Examiner*—Christopher Kilner

*Attorney, Agent, or Firm*—Willard Jones, II

[57] ABSTRACT

A refrigeration system using air as the refrigerant comprises a compressor which compresses air to 84 bar g. The compressed air is cooled first by cooling water and then by returning air in a plate-fin heat exchanger before being expanded to 59 bar g in an expander. The expanded air at –61° C. is passed through indirect cooling coils in a cold store which it leaves at –45° C. This air is then passed through the plate-fin heat exchanger before being recycled to the compressor. The refrigeration delivered is about 1.05 kw refrigeration/kw power input.

21 Claims, 2 Drawing Sheets

REFRIGERATION SYSTEM

FIELD OF THE INVENTION

This invention relates to a refrigeration system and to a method of operating the same.

BACKGROUND OF THE INVENTION

Domestic and commercial refrigeration systems generally use a variety of fluorocarbons and hydrofluorocarbons as refrigerant. Many of the these refrigerants are believed to be responsible for the diminution of the ozone layer above the Earth and legislation is being proposed in many countries to ban or strictly limit the use of such refrigerants.

It has been known for many years that air can be used as a refrigerant. However, refrigeration systems using air have been extremely inefficient compared with refrigeration systems using other refrigerants.

In one historic refrigeration system air was compressed, cooled to room temperature and then expanded to ambient pressure. Typically, the air was compressed to about 100 bar g and, after being cooled to room temperature and expanded through a Joule-Thompson valve to ambient pressure left the Joule-Thompson valve at about −40° C. When applied to commercial refrigeration units, for example the holds of ships carrying food to the colonies, the refrigeration delivered was typically about 0.2 kw refrigeration per kw of energy input. Current systems have been designed using turbo expanders in place of Joule-Thompson valves to reduce the energy consumption. These generally operate with the turbine discharging at close to atmospheric pressure. The refrigeration delivered is typically 0.4 kw refrigeration per kw of energy input. This compares with about 1.25 kw refrigeration per kw of energy input for a modern refrigeration system using a fluorocarbon as refrigerant.

The aim of the present invention is to provide a refrigeration system using air, nitrogen or nitrogen enriched air as the refrigerant and having a power consumption which approaches the power consumption of the modern refrigeration system mentioned above.

SUMMARY OF THE PRESENT INVENTION

According to the invention there is provided a refrigeration system comprising:

(i) a compressor for compressing air, nitrogen or nitrogen enriched air to a pressure of from 20 bar g to 140 bar g;

(ii) a heat exchanger for cooling said compressed air, nitrogen or nitrogen enriched air;

(iii) an expander for expanding said cooled compressed air, nitrogen or nitrogen enriched air to a pressure in the range of from 15 bar g to 110 bar g;

(iv) a cooling device for receiving cold expanded air, nitrogen or nitrogen enriched air; and (v) means for conveying air, nitrogen or nitrogen enriched air from said cooling device to said heat exchanger at a temperature of −20° C. to −120° C. for cooling said air, nitrogen or nitrogen enriched air.

Preferably, said refrigeration system further comprises means to recycle said air, nitrogen or nitrogen enriched air to said compressor.

Advantageously, said heat exchanger is a plate-fin heat exchanger.

Preferably, the compressor is coupled to the expander. This may be by, for example a drive shaft or via a gear system so that, in use, the speed of rotation of the expander is in a fixed ratio to the speed of rotation of the compressor.

The present invention also provides a method of operating a refrigeration system according to the invention, which method comprises the steps of:

(i) compressing air, nitrogen or nitrogen enriched air to a pressure from 20 bar g to 140 bar g, (ii) cooling said compressed air, nitrogen or nitrogen enriched air, (iii) expanding said compressed air, nitrogen or nitrogen enriched air to a pressure in the range of from 15 bar g to 110 bar g, (iv) using said expanded air, nitrogen or nitrogen enriched air to cool a refrigerated space, (v) withdrawing said expanded air, nitrogen or nitrogen enriched air from said refrigerated space at a temperature of from −20° C. to −120° C., (vi) using said expanded air, nitrogen or nitrogen enriched air withdrawn from, said refrigerated system for at least partially cooling said compressed air, nitrogen or nitrogen enriched air prior to expansion thereof.

Preferably, the expanded air, nitrogen or nitrogen enriched air is withdrawn from the refrigeration space at a temperature of from −20° C. to −100° C.

Advantageously, the pressure of the expanded air, nitrogen or nitrogen enriched air from step (iii) is from 0.6 to 0.85 the pressure of the compressed air from step (i).

Preferably, said method includes the step of recycling air, nitrogen or nitrogen enriched air from step (vi) for recompression.

Advantageously, said air, nitrogen or nitrogen enriched air is compressed to a pressure of from 70 bar g to 100 bar g, and more advantageously from 80 bar g to 90 bar g.

Preferably, said air, nitrogen or nitrogen enriched air is expanded to a pressure of from 50 bar g to 80 bar g, and more preferably from 50 bar g to 70 bar g.

Advantageously, said expanded air, nitrogen or nitrogen enriched air is withdrawn from said refrigerated space at a temperature of from −30° C. to −100° C., preferably from −30° C. to −50° C. and more preferably from −35° C. to −45° C. or from −70 ° C. to −90° C., more preferably from −75° C. to −85° C.

For a better understanding of the invention reference will now be made, by way of example, to the accompanying drawings, in which

DETAILED DESCRIPTION OF THE PREFERRED EMBODIMENTS

Figure 1:
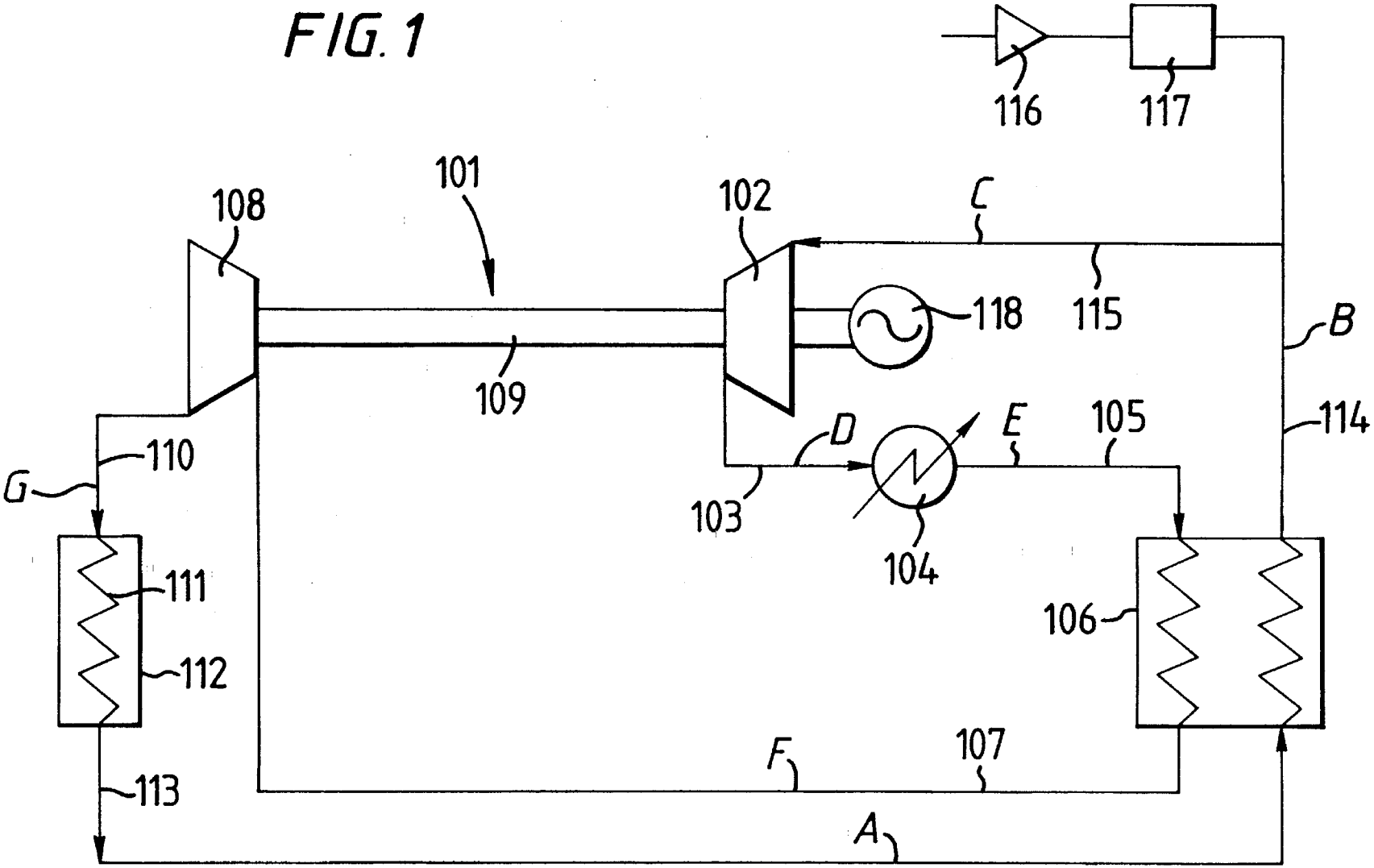
FIG. 1 is a flow sheet of one embodiment of refrigeration system in accordance with the present invention.

Referring to the drawing, there is shown a refrigeration system which is generally identified by reference numeral 101.

The refrigeration system 101 comprises a compressor 102 which is arranged to compress feed air. The compressed air passes through pipe 103 into a heat exchanger 104 where it is cooled by indirect heat exchange with cooling water. The cooled compressed air leaves the heat exchanger 104 through pipe 105 and passes into a plate fin heat exchanger 106 where it is further cooled. The further cooled compressed air leaves plate fin heat exchanger 106 through pipe 107 and is introduced into an expander 108 which is connected to the compressor 102 via a drive shaft 109.

Cold expanded air leaves the expander 108 through pipe 110 and passes into cooling coils 111 in a cold store 112. The partially warmed expanded air leaves the cooling coils 111 through pipe 113 and is passed through plate fin heat exchanger 106 in counter-current flow to the cooled compressed air which it cools.

The warmed air leaves the plate-fin heat exchanger 106 through pipe 114 and is recycled to the compressor 102 via pipe 15. Make-up air is provided by a small compressor 116 which compresses ambient air and passes it through a dryer 117 which removes moisture. The makeup air compensates for any air loss from the refrigeration system 101.

Compressor 102 is driven by the power generated in the expander 108 with the balance provided by the motor 118.

Table 1 shows the properties of the air at points A to I marked on FIG. 1. With this arrangement the refrigeration delivered is calculated to be 1.05 kw refrigeration per kw energy input to motor M.

It will be noted that this compares extremely favourably with the prior art FREON (RTM) refrigeration system described above and, is far more efficient than the prior art air refrigeration systems described.

Figure 2:
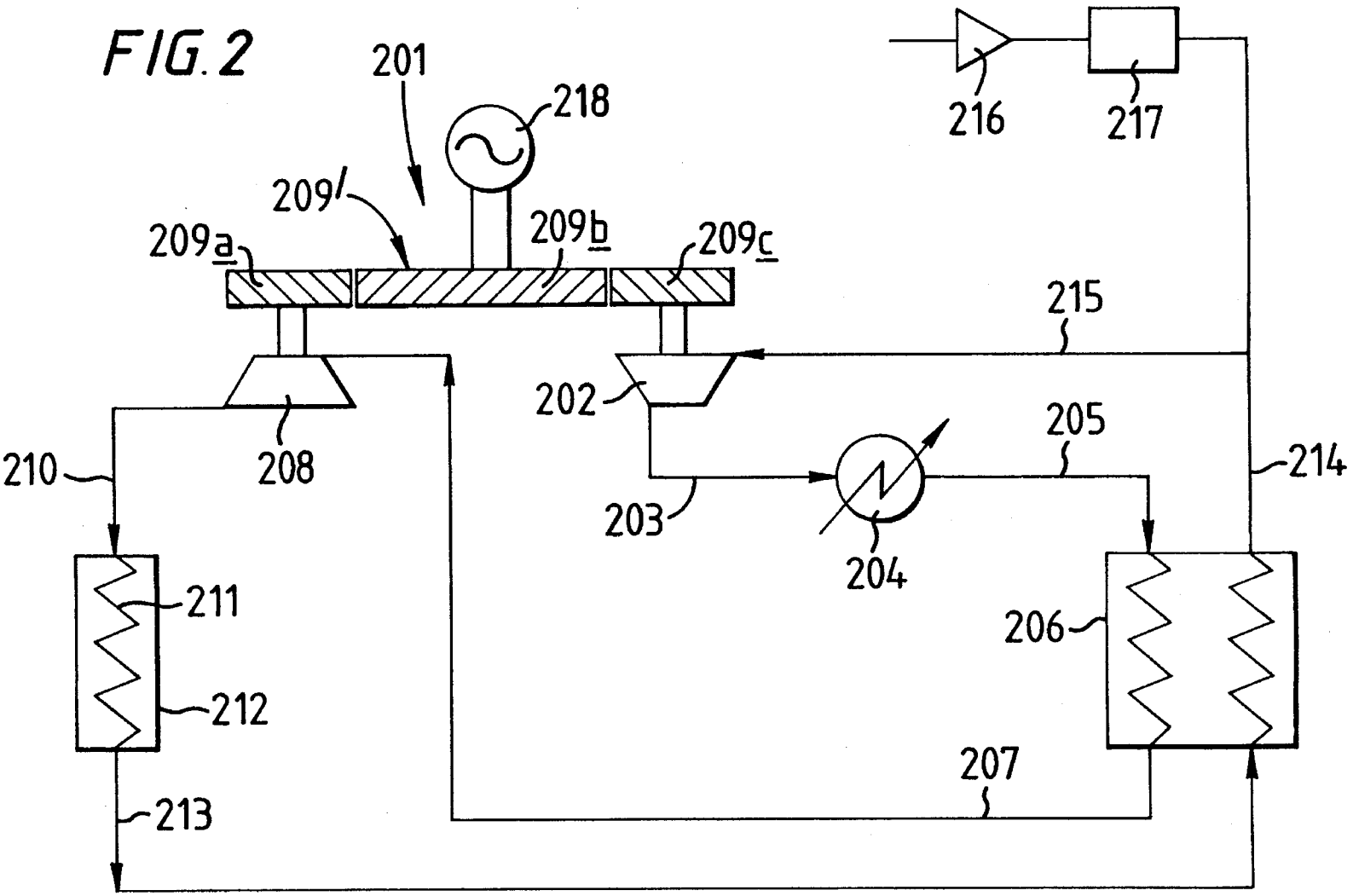
FIG. 2 is a flow sheet of a second embodiment of a refrigeration system in accordance with the present invention.

Referring now to FIG. 2, the refrigeration system shown is generally similar to that shown in FIG. 1 and parts having similar functions to parts in FIG. 1 have been identified by similar reference numerals in the "200" series.

In particular, the refrigeration system, which is generally identified by reference number 201 comprises a compressor 202 which is arranged to compress feed air. The compressed air passes through pipe 203 into a heat exchanger 204 where it is cooled by indirect heat exchange with cooling water. The cooled compressed air leaves the heat exchanger 204 through pipe 205 and passes into a plate fin heat exchanger 206 where it is further cooled. The further cooled compressed air leaves plate fin heat exchanger 206 through pipe 207 and is introduced into an expander 208 which is connected to the compressor 202 via a gear system 209' comprising gear wheels **209*a*, 209*b* and 209*c*. In particular gear wheel 209*a* is fast with the expander 208 and in meshing engaging with gear wheel 209*b* which is in meshing engagement with gear wheel 209*c* fast with compressor 202. A motor 218 is connected to gear wheel 209*b*** as shown.

Cold expanded air leaves the expander 208 through pipe 210 and passes into cooling coils 211 in a food freezer 212. The partially warmed expanded air leaves the cooling coils 211 through pipe 213 and is passed through plate fin heat exchange 206 in counter-current flow to the cooled compressed air which it cools.

The warmed air leaves the plate-fin heat exchanger 206 through pipe 214 and is recycled to the compressor 202 via pipe 215.

Make-up air is provided by a small compressor 216 which compresses ambient air and passes it through a dryer 217 which removes moisture. The make-up air compensator for any air loss from the refrigeration system 201.

Compressor 202 is driven by the power generated in the expander 208 with the balance provided by the motor 218.

Whilst air is the much preferred refrigerant for the refrigeration systems described with reference to the drawings nitrogen or nitrogen enriched air could also be used as alternative refrigerants.

TABLE 1

| STREAM ID | | A | B | C | D | E | F | G |
|---|---|---|---|---|---|---|---|---|
| Phase | Vap/Liq | Vap | Vap | Vap | Vap | Vap | Vap | Vap |
| Total Flow | kgmol/sec | 1.00 | 1.00 | 1.00 | 1.00 | 1.00 | 1.00 | 1.00 |
| Temperature | C | −45.0 | 16.9 | 16.7 | 54.8 | 19.9 | −39.6 | −61.2 |
| Pressure | bara | 59.5 | 59.3 | 59.2 | 85.0 | 84.7 | 84.4 | 60.0 |
| Enthalpy | kW | −2709 | −661 | −661 | 412 | −723 | −2771 | −3293 |
| Entropy | J/(kg K) | −1355 | −1079 | −1079 | −1062 | −1187 | −1457 | −1449 |

What is claimed is:

1. A refrigeration system comprising:

(i) a compressor for compressing air, nitrogen or nitrogen enriched air to a pressure of from 20 bar g to 140 bar g;

(ii) a heat exchanger for cooling said compressed air, nitrogen or nitrogen enriched air;

(iii) an expander for expanding said cooled compressed air, nitrogen or nitrogen enriched air to a pressure in the range of from 15 bar g to 110 bar g;

(iv) a cooling device for receiving cold expanded air, nitrogen or nitrogen enriched air; and (v) means for conveying air, nitrogen or nitrogen enriched air from said cooling device at a temperature of from −20° C. to −120° C. to said heat exchanger for cooling said air, nitrogen or nitrogen enriched air.

2. A refrigeration system as claimed in claim 1, further comprising means to recycle said air, nitrogen or nitrogen enriched air to said compressor.

3. A refrigeration system as claimed in claim 1, wherein said heat exchanger is a plate fin heat exchanger.

4. A refrigeration system as claimed in claim 1, wherein said compressor is connected to said expander via a gear system so that, in use, the speed of rotation of the expander is in a fixed ratio to the speed of rotation of the compressor.

5. A method of operating a refrigeration system, which method comprises the steps of:

(i) compressing air, nitrogen or nitrogen enriched air to a pressure from 20 bar g to 140 bar g in a compressor;

(ii) cooling said compressed air, nitrogen or nitrogen enriched air in a heat exchanger;

(iii) expanding said compressed air, nitrogen or nitrogen enriched air in an expander to a pressure in the range of from 15 bar g to 110 bar g;

(iv) using said expanded air, nitrogen or nitrogen enriched air to cool a refrigerated space;

(v) withdrawing said expanded air, nitrogen or nitrogen enriched air from said refrigerated space at a temperature of from −20° C. to −120° C.; and (vi) introducing said expanded air, nitrogen or nitrogen enriched air withdrawn from said refrigerated system into said heat exchanger for at least partially cooling said compressed air, nitrogen or nitrogen enriched air prior to expansion thereof.

6. A method according to claim 5, wherein said expanded air, nitrogen or nitrogen enriched air is withdrawn from said refrigerated space at a temperature of from −20° C. to −100° C.

7. A method according to claim 5, wherein the pressure of the expanded air, nitrogen or nitrogen enriched air from step (iii) is from 0.6 to 0.85 the pressure of the compressed air from step (i).

8. A method according to claim 5, including the step of recycling air, nitrogen or nitrogen enriched from step (vi) for recompression.

9. A method according to claim 5, wherein said air, nitrogen or nitrogen enriched air is compressed to a pressure of from 70 bar g to 100 bar g.

10. A method according to claim 9, wherein said air, nitrogen or nitrogen enriched air is compressed to a pressure of from 80 bar g to 90 bar g.

11. A method according to claim 8, wherein said air, nitrogen or nitrogen enriched air is expanded to a pressure of from 50 bar g to 80 bar g.

12. A method according to claim 11, wherein said air, nitrogen or nitrogen enriched air is expanded to a pressure of from 50 bar g to 70 bar g.

13. A method according to claim 8, wherein said expanded air, nitrogen or nitrogen enriched air is withdrawn from said refrigerated space at a temperature of from −30° C. to −100° C.

14. A method according to claim 13, where said expanded air, nitrogen or nitrogen enriched air is withdrawn from said refrigerated system at a temperature of from −30° C. to −50° C.

15. A method according to claim 14, wherein said expanded air, nitrogen or nitrogen enriched air is withdrawn from said refrigerated space at a temperature of −35° C. to −45° C.

16. A method according to claim 15, wherein said expanded air, nitrogen or nitrogen enriched air is withdrawn from said refrigerated space at a temperature of from −70° C. to −90° C.

17. A method according to claim 16, wherein said expanded air, nitrogen or nitrogen enriched air is withdrawn from said refrigerated space at a temperature of from −75° C. to −85° C.

18. A method of operating a refrigeration system, which method comprises the steps of:

(i) compressing air, nitrogen or nitrogen enriched air to a pressure from 20 bar g to 140 bar g in a compressor;

(ii) cooling said compressed air, nitrogen or nitrogen enriched air in a heat exchanger;

(iii) expanding said compressed air, nitrogen or nitrogen enriched air in an expander to a pressure which is in the range of from 15 bar g to 110 bar g and is also in the range of from 0.6 to 0.85 the pressure of the compressed air, nitrogen or nitrogen enriched air from step (i);

(iv) using said expanded air, nitrogen or nitrogen enriched air to cool a refrigerated space;

(v) withdrawing said expanded air, nitrogen or nitrogen enriched air from said refrigerated space at a temperature of from −20° C. to −120° C.;

(vi) introducing said expanded air, nitrogen or nitrogen enriched air withdrawn from said refrigerated system into said heat exchanger for at least partially cooling said compressed air, nitrogen or nitrogen enriched air prior to expansion thereof; and (vii) recycling air, nitrogen or nitrogen enriched from step (vi) for recompression.

19. A method according to claim 18, wherein said expanded air, nitrogen or nitrogen enriched air is withdrawn from said refrigerated space at a temperature of from −20° C. to −100° C.

20. A method according to claim 5, wherein said air, nitrogen or nitrogen enriched air is compressed to a pressure of from 70 bar g to 100 bar g.

21. A method according to claim 18, wherein said expanded air, nitrogen or nitrogen enriched air is withdrawn from said refrigerated space at a temperature of from −30° C. to −100° C.

* * * * *